US007621818B1

(12) United States Patent
Tippit

(10) Patent No.: US 7,621,818 B1
(45) Date of Patent: Nov. 24, 2009

(54) SYSTEM FOR ASSEMBLY AND LEVELING OF PLAYING SURFACE FOR BILLIARDS

(76) Inventor: Tilden S. Tippit, 201 Potters Mill Ave., Daphne, AL (US) 36526

( * ) Notice: Subject to any disclaimer, the term of this patent is extended or adjusted under 35 U.S.C. 154(b) by 230 days.

(21) Appl. No.: 11/804,323

(22) Filed: May 18, 2007

(51) Int. Cl.
*A63D 15/04* (2006.01)
*A63D 15/00* (2006.01)

(52) U.S. Cl. ..... 473/10; 473/1; 473/4; 473/15; 297/127

(58) Field of Classification Search ..... 473/10, 473/1, 9, 14, 15, 16; 297/127, 128
See application file for complete search history.

(56) References Cited

U.S. PATENT DOCUMENTS 244,324 A * 7/1881 Sherman ..... 473/10
509,277 A * 11/1893 Woodman ..... 297/127
559,927 A * 5/1896 Balke ..... 473/10
766,072 A * 7/1904 Stone ..... 473/10
786,693 A * 4/1905 Stone ..... 297/128
816,616 A * 4/1906 Stone ..... 297/127
3,341,198 A * 9/1967 Turpin, Sr. ..... 473/10
3,889,945 A 6/1975 Ellis
3,913,973 A * 10/1975 Mintz et al. ..... 297/127
3,988,021 A 10/1976 Grover
4,925,256 A * 5/1990 Vargas et al. ..... 312/237
5,882,265 A 3/1999 Benton

* cited by examiner

*Primary Examiner*—Mitra Aryanpour
(74) *Attorney, Agent, or Firm*—George L. Williamson

(57) ABSTRACT

A system to allow quick setup of a support structure and connected playing surface with rapid leveling of the playing surface for playing billiards. One embodiment of the invention allows the playing surface to be mounted to a support structure that can be converted to a couch. This embodiment can be placed in residential housing in rooms such as dens, family rooms, or living rooms. Another embodiment of the invention allows the playing surface when mounted to legs rigidly connected to a floor to be used on a concrete patio, a garage with a concrete floor or on a wooden deck.

9 Claims, 12 Drawing Sheets

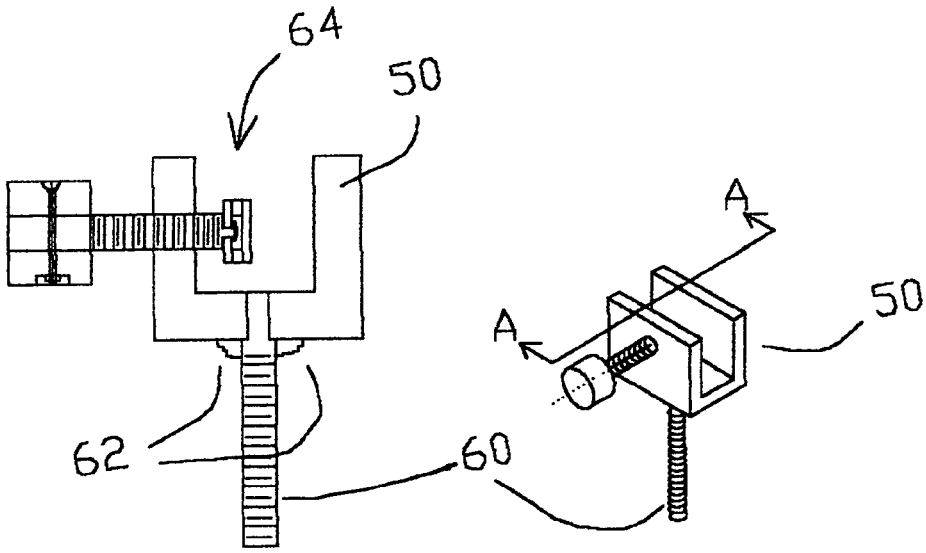
FIG 8A
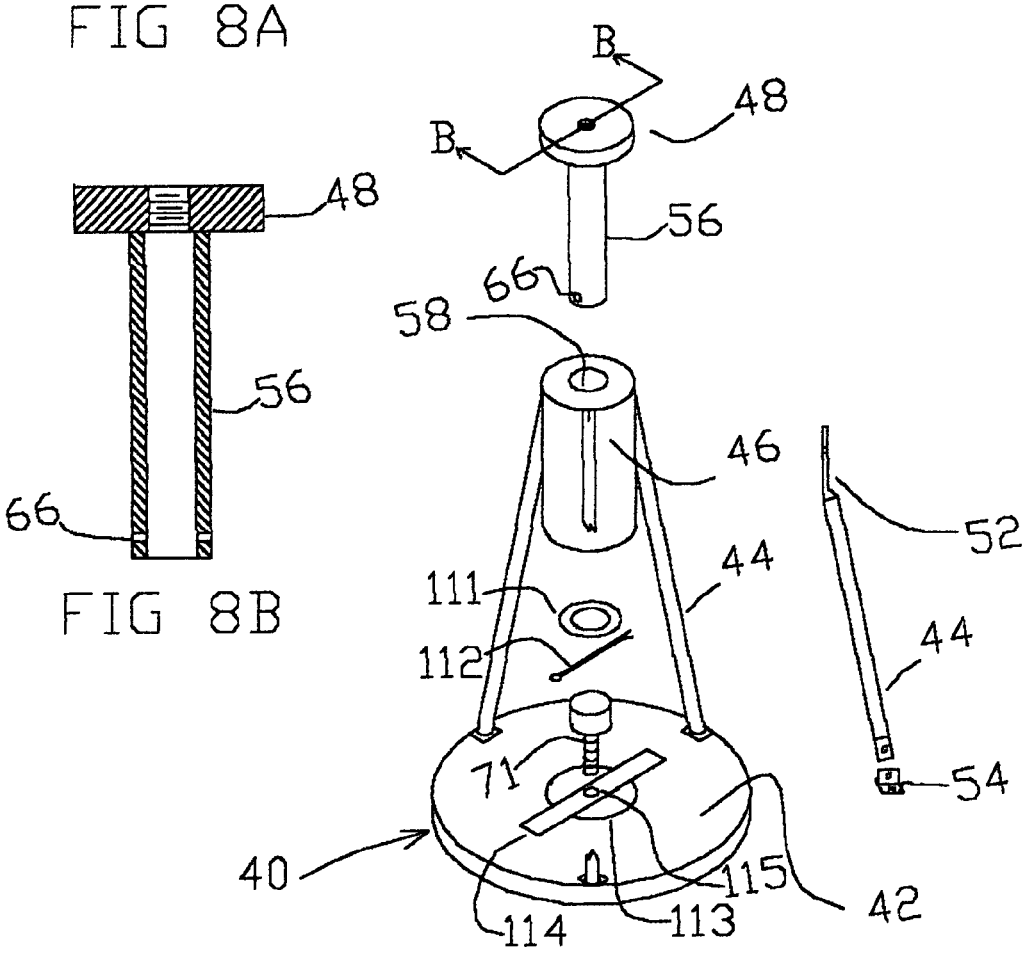
FIG 8B
FIG 8

SYSTEM FOR ASSEMBLY AND LEVELING OF PLAYING SURFACE FOR BILLIARDS

BACKGROUND OF THE INVENTION

1. Field of the Invention

The present invention generally relates to billiard tables and, more particularly, is concerned with a device to accelerate the assembly and leveling of a playing surface and support structure therefor so that billiards may be played on the playing surface.

2. Description of the Prior Art

Various types of pool tables have been described in the prior art. However, none of the prior art discloses the unique features of the present invention.

U.S. Pat. No. 3,913,973, dated Oct. 21, 1975, to Mentz, et al disclosed a combination pool table and couch.

U.S. Pat. No. 786,693, dated Apr. 4, 1905 to Stone disclosed a convertible sofa and table.

U.S. Pat. No. 3,988,021, dated Oct. 26, 1976, to Grover disclosed a game table.

U.S. Pat. No. 3,889,945 dated Jun. 17, 1975, to Ellis disclosed a billiard table with accessories.

U.S. Pat. No. 816,616, dated Apr. 3, 1906, to Stone disclosed a convertible sofa and table.

U.S. Pat. No. 5,882,265, dated Mar. 16, 1999, to Benton disclosed a vertically storable and self-leveling billiard table.

While these pool tables may be suitable for the purposes in which they were designed, they would not be suitable for the purposes of the present invention as hereinafter described.

SUMMARY OF THE PRESENT INVENTION

The present invention discloses a system to allow quick setup of a support structure and connected playing surface with rapid leveling of the playing surface for playing billiards. One embodiment of the invention allows the playing surface to be mounted to a support structure that can be converted to a couch. This embodiment can be placed in residential housing in rooms such as dens, family rooms, or living rooms. Another embodiment of the invention allows the playing surface when mounted to legs rigidly connected to a floor to be used on a concrete patio, a garage with a concrete floor or on a wooden deck.

An object of the present invention is to provide a device suitable for a space that is occupied by a conventional heavy billiard table in a house which can be quickly made available for other uses by quick disconnection and easy storage of the playing surface with the supporting structure being used as a couch.

Another object of the present invention is to provide a device that uses a support structure rigidly connected to the floor which enables quick setup for the game of billiards on a wooden deck or concrete floor. The support structure which consists of four legs and two supporting members can be stored on a wall along with the lightweight playing surface.

Another object of the present invention is to provide a device that can be quickly leveled using a leveling system that is manual or electrically-assisted.

Another object of the present invention is to provide a device for a set of billiard balls already racked in a triangular rack and placed in a surrounding triangular storage container which speeds up the time required to attain readiness for play. To place the billiard balls onto the playing surface simply pull the rack out of the storage container and place the balls in the required position for play.

Another object of the present invention is to provide a device for a couch support structure, readily accessible cue storage being provided that negates the necessity for wall mounted cue storage. Thus the cues, billiard balls already racked, cue ball, and chalk are stored directly on-board the couch structure.

The foregoing and other objects and advantages will appear from the description to follow. In the description reference is made to the accompanying drawings, which form a part hereof, and in which is shown by way of illustration-specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views. The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which:

FIG. 8 is an exploded perspective view of portions of the present invention.

FIG. 8A is a sectional view of portions of the present invention.

FIG. 8B is a sectional view of portions of the present invention.

LIST OF REFERENCE NUMERALS

Figure 1:
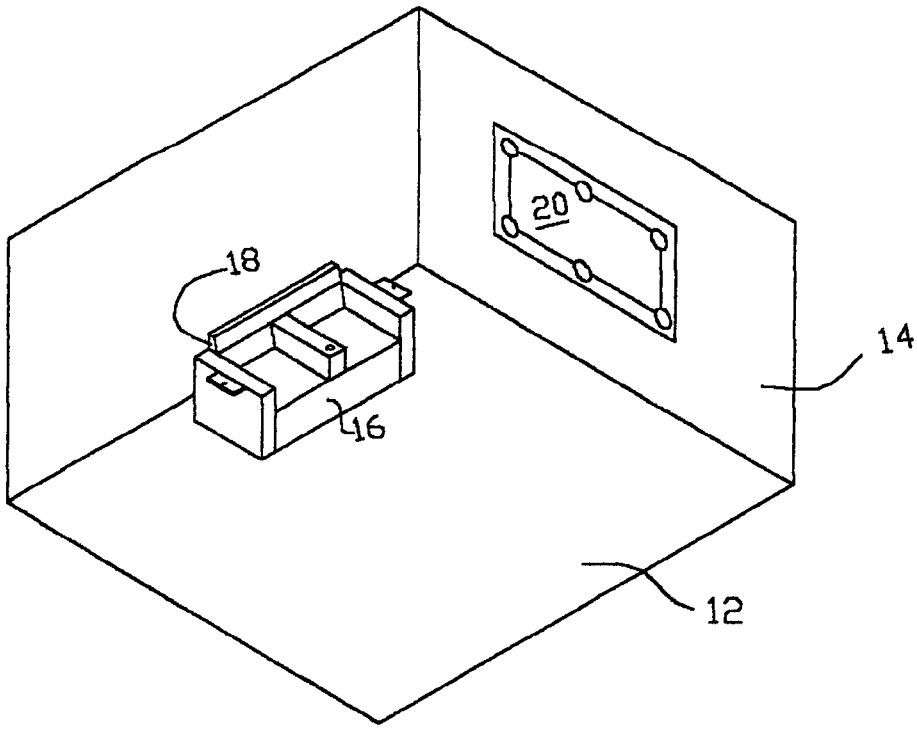
FIG. 1 is a perspective view of portions of the present invention.

With regard to reference numerals used, the following numbering is used throughout the drawings.

10 present invention
12 room
14 wall
16 couch
18 back support
20 playing surface
21 pockets
22 connecting bolt
23 threaded portion
24 aperture
26 caster
28 leveler
30 storage
32 cue holes
34 plug
36 hand hole
37 upper member
38 wall mounting fixtures
39 lower member
40 stand alone leg
42 base
44 elongated member
46 axle
48 nut
50 2×4/lumber clamp
52 leg crimp
54 T-shaped connector
56 axle
58 aperture
60 threaded rod
62 weld
64 fastener
66 hole
68 concrete floor
70 threaded lead insert
71 hand bolt
72 wood deck
74 threaded plate
76 2×4/lumber support
78 container
80 lid
82 container
84 flap
86 rack
88 pool balls
90 futon/mattress
92 end member
94 threaded aperture
96 center support
98 threaded hole
100 threaded rod
102 threaded nut
104 hand bolt
106 chalk
108 cue ball
110 end cap
111 washer
112 cotter pin
113 viewing hole
114 metal plate
116 knob
118 threaded rod
120 steel tube
122 pipe
124 plug
126 guide
128 plug
130 washer
132 weld
134 threaded nut
136 washer
138 cotter pin
140 end plug
142 aperture
144 motor
146 gear box
148 collar
150 pendulum
152 level sensor
154 electrode
156 electrode
158 battery
160 coil
162 relay
164 contact
166 battery
168 relay
170 battery
172 terminal
174 terminal
176 ground

DETAILED DESCRIPTION OF THE PREFERRED EMBODIMENT

The following discussion describes in detail at least one embodiment of the present invention. This discussion should not be construed, however, as limiting the invention to those particular embodiments since practitioners skilled in the art will recognize numerous other embodiments as well. For a definition of the complete scope of the invention, the reader is directed to the appended claims. FIGS. 1-18 illustrate the present invention wherein a system for accelerated assembly and leveling of a billiard playing surface and support surface therefor is disclosed.

Billiard tables are characteristically constructed of heavy materials because the playing surface and its supporting structure must be very stable in order for the table to be unaffected by bumping of the table by the player's body or by movement induced to the table by the balls hitting the rails. Ideally, there is no motion imparted to the billiard balls as the result of movement or vibration of the supporting structure. A heavy billiard table must be placed in the space where play occurs and remain in the same space when the table is not being used for play. This is because of the unwieldy and difficult task of moving the heavy billiard table. Individuals with very large homes can afford the luxury of having enough space to dedicate permanently that space required for a heavy billiard table. However, many individuals cannot afford the luxury of dedicating so much space to a billiard table. This invention is primarily intended for use by those individuals who must utilize the space required for a billiard table for other activities when the table is not being used.

With the advent of the fabrication of lightweight playing surfaces using composite materials such as foam for a core and fabric/epoxy or aluminum skins, a playing surface that is much less in weight than slate or heavy materials that imitate slate can be realized. Unlike a heavy playing surface, the composite playing surface may be lifted by two humans with relative ease and moved from its storage space to the space where the playing surface enables the game of billiards to be played. In order to achieve the required stability, the playing surface must be connected to a heavy support structure or connected to a structure that is rigidly connected to the floor.

Figure 2:
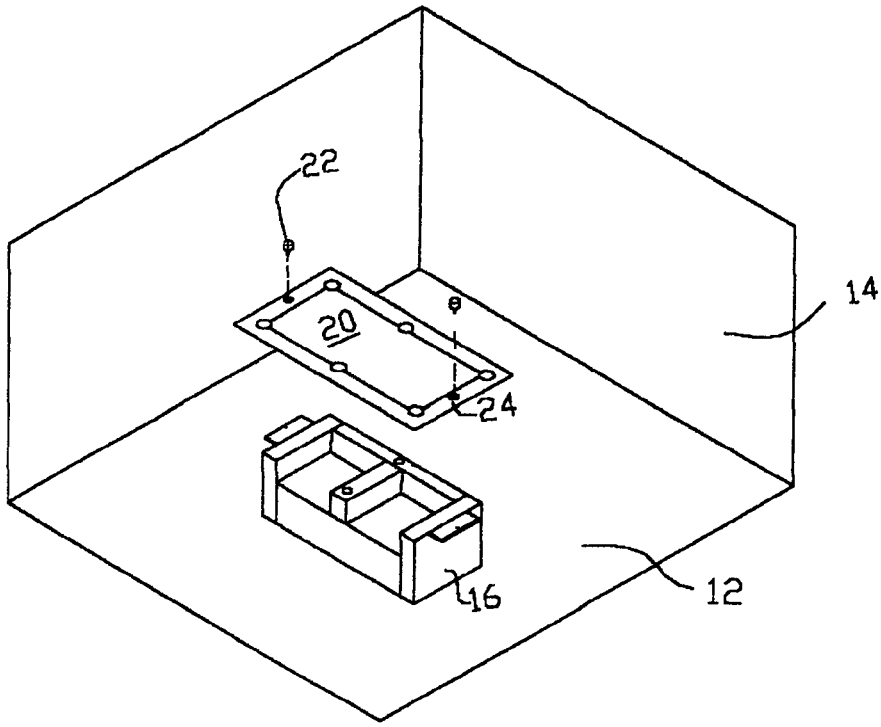
FIG. 2 is a perspective view of portions of the present invention.

Turning to FIGS. 1 and 2, shown therein is the interior of a room 12 having a wall 14 thereon. Also shown is couch 16 with a removable back support 18 having the removable playing surface 20 disposed on wall 14. Couch 16 has a front side, a back side and a pair of opposite ends or arms. Also shown are a pair of connecting hand bolts 22 which are mounted through apertures 24 on each end of the playing surface 20 for insertion into and attachment to the ends of the couch 16. FIG. 1 shows the playing surface removed from couch 16 with back support 18 on the couch. FIG. 2 shows the playing surface 20 being attached to the couch 16 having back support 18 removed therefrom.

Figure 3:
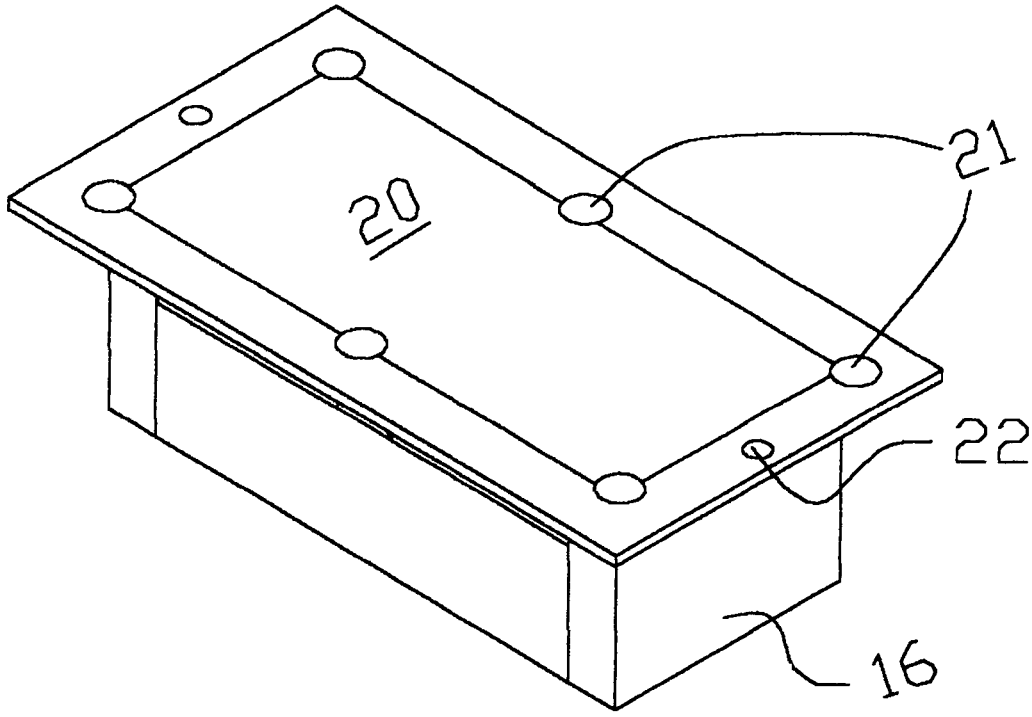
FIG. 3 is a perspective view of portions of the present invention.
Figure 4:
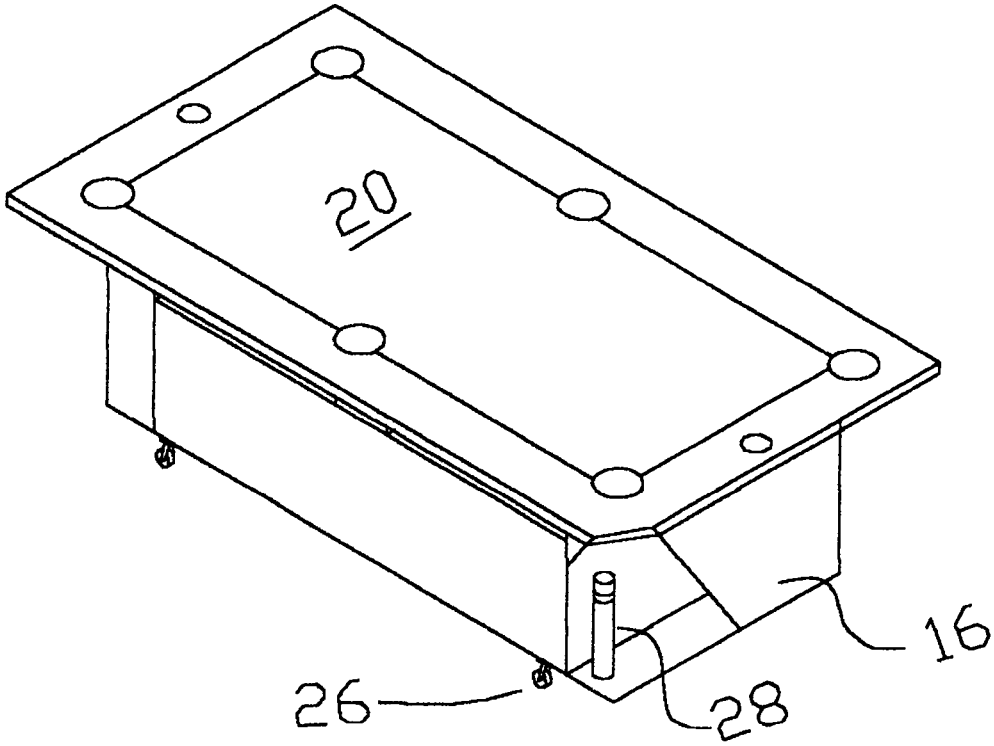
FIG. 4 is a perspective view of portions of the present invention.
Figure 5:
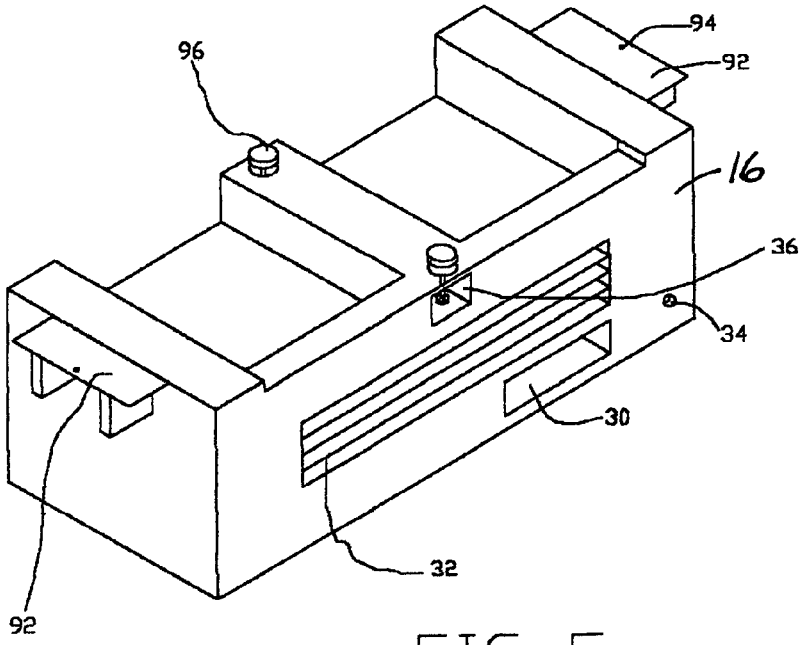
FIG. 5 is a perspective view of portions of the present invention.

Turning to FIGS. 3, 4 and 5, shown therein is shown a couch 16 having playing surface 20 thereon having a plurality of conventionally placed pockets 21 along with connecting hand bolts 22. Playing surface 20 is generally rectangular having a front side, a rear side and a pair of ends corresponding to the sides of the couch 16 and an upper and lower surface wherein billiards are played on the upper surface. Also shown are multiple casters on each corner of the couch 16 along with a leveler 28 disposed at each corner of the couch. Also shown is the rear side of the couch in FIG. 5 showing a storage area for a rack and ball container 30, multiple slotted cue holders 32, a male three prong plug 34 to accept an extension cord along with a hand hole 36 needed to adjust the center support 96 having a portion thereof pass through the hand hole which center supports are located in about the middle of the front and back sides of the couch 16 and also showing end member 92 on each end having a threaded aperture 94 therein.

Figure 6:
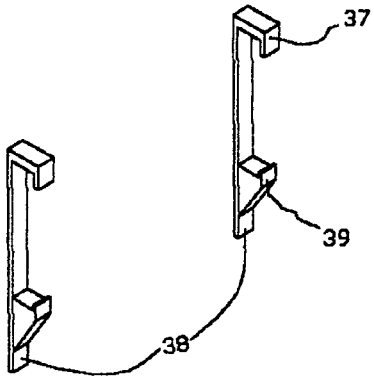
FIG. 6 is a perspective view of portions of the present invention.
Figure 7:
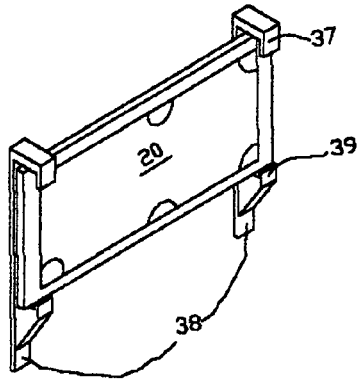
FIG. 7 is a perspective view of portions of the present invention.

Turning to FIGS. 6 and 7, shown therein is the wall mounting fixtures 38 being a pair thereof which are used for receiving the playing surface 20 therein between the mounts 38 which are mounted onto the wall as previously disclosed. Each mount 38 has an upper member 37 with a downwardly disposed protrusion thereon and a lower member with an upwardly disposed protrusion thereon wherein a side of the playing surface is removably placed in the upper and lower protrusions.

Figure 9A:
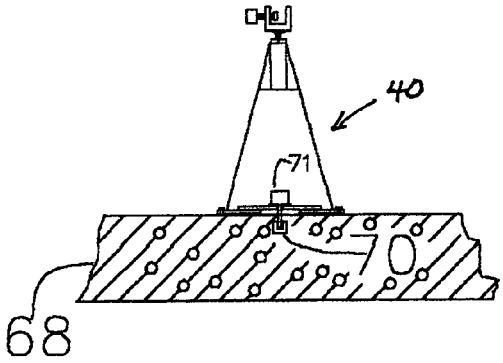
FIG. 9A is a perspective view of portions of the present invention.
Figure 9B:
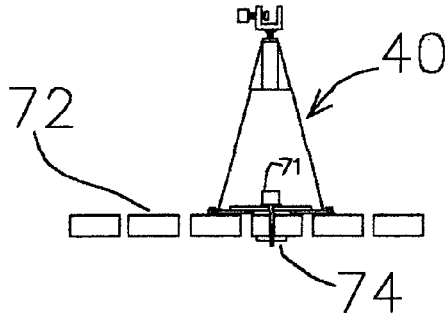
FIG. 9B is a perspective view of portions of the present invention.
Figure 10:
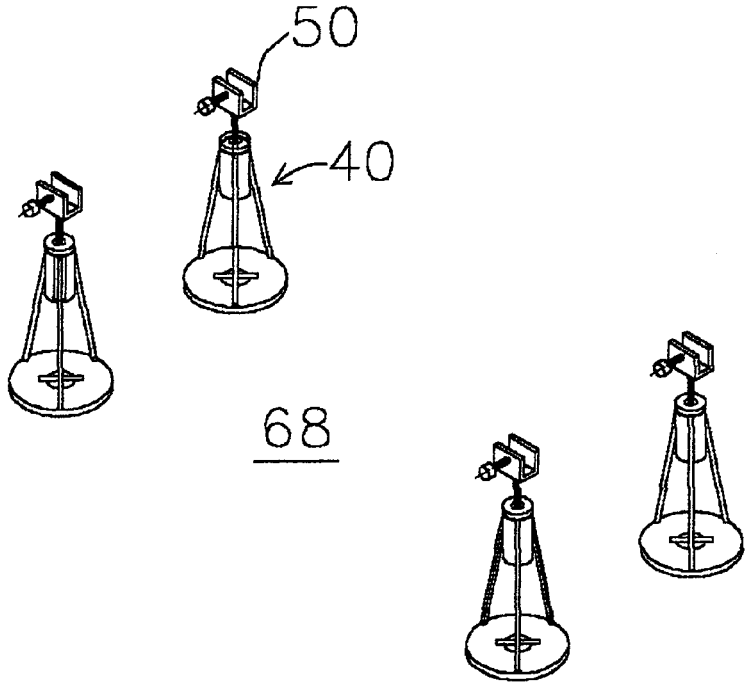
FIG. 10 is a perspective view of portions of the present invention.

Turning to FIGS. 8-10, shown therein are the stand alone legs 40 having a base 42, multiple elongated members or legs 44, a hollow axle 46, adjusting nut 48 and an upwardly disposed U-shaped lumber or 2×4 clamp 50. Metal plate 114 with aperture 115 therein spans viewing hole 113 allowing hand bolt 71 to be visually aligned with either threaded insert 70 or threaded plate 74. It can be seen that the legs 44 have a metal tubing crimped flat on one end 52 and a T-shaped connector 54 on the other end which connects the metal conduit tube to the base 42 by fitting into a slot in the tube. Adjusting nut 48 with hollow axle 56 fits in the aperture 58 of axle 46. The 2×4 clamp 50 also has a ¾" rod 60 thereon. Washer 111 fits around hollow axle 56 and cotter pin 112 fits into aperture 66 to prohibit vertical movement of hollow axle 56. FIG. 8A shows a cross section of 2×4 clamp 50 having a threaded rod 60 thereon with welds 62 and a horizontally disposed adjusting locking fastener 64. FIG. 8B is a cross section of adjusting nut 48 showing the end 56 and a hole 66 for receiving a cotter pin. FIG. 9A shows the stand-alone leg 40 disposed on a concrete floor 68 having a hand bolt 71 connected to a threaded lead insert 70 for attachment to the floor. FIG. 9B also shows the leg assembly 40 attached to a wooden deck 72 having a hand bolt 71 connected to a threaded plate 74 for attachment to the deck. FIG. 10 shows the legs 40 positioned as they would be on a concrete floor 68 or a wood deck 72 placed in position with 2×4 clamps 50 for receiving the 2×4 horizontal supports as herein disclosed.

Figure 11:
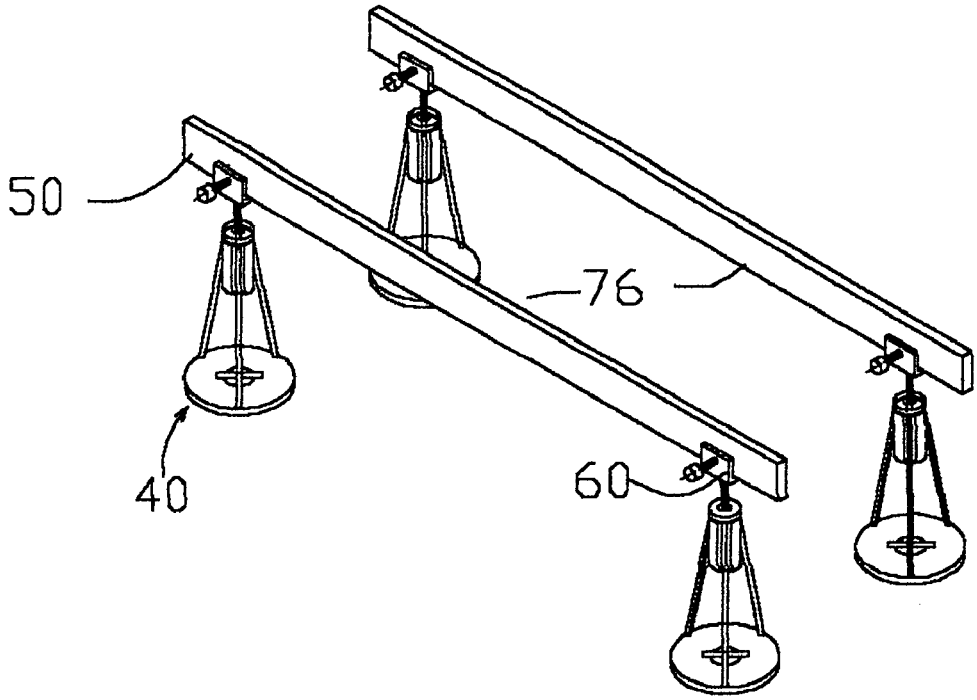
FIG. 11 is a perspective view of portions of the present invention.
Figure 12:
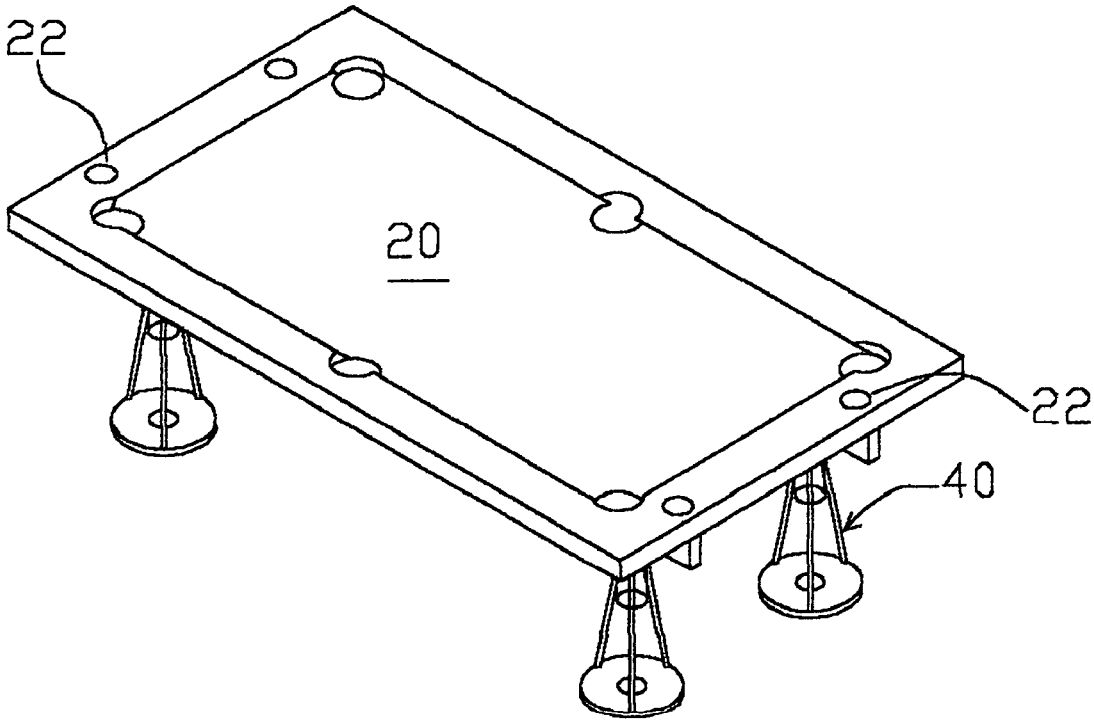
FIG. 12 is a perspective view of portions of the present invention.

Turning to FIGS. 11 and 12, shown therein are the leg members 40 having the horizontal lumber supports 76 mounted thereon to clamps 50 so that the underside of playing surface 20 can be placed on the lumber supports and using connecting bolts 22 for attaching the playing surface to the lumber supports. Lumber supports 76 may be 2×4 pieces of lumber.

Figure 13B:
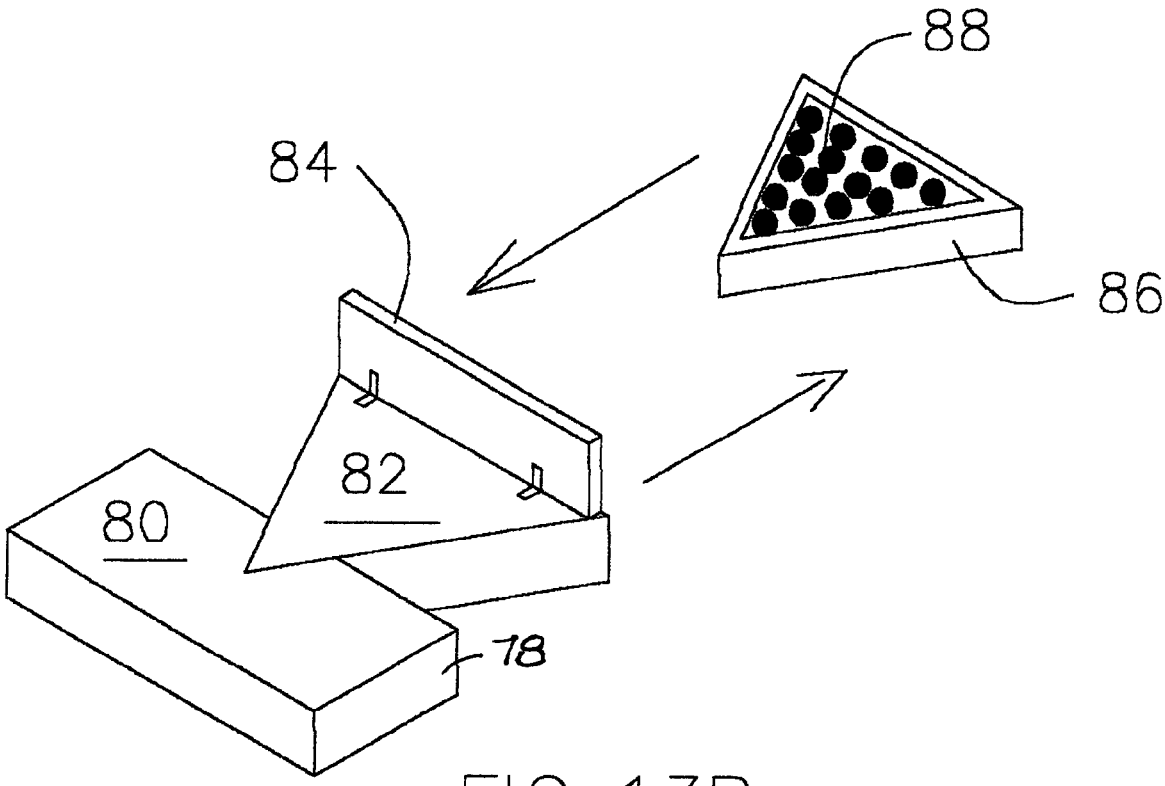
FIG. 13B is a perspective view of portions of the present invention.
Figure 13A:
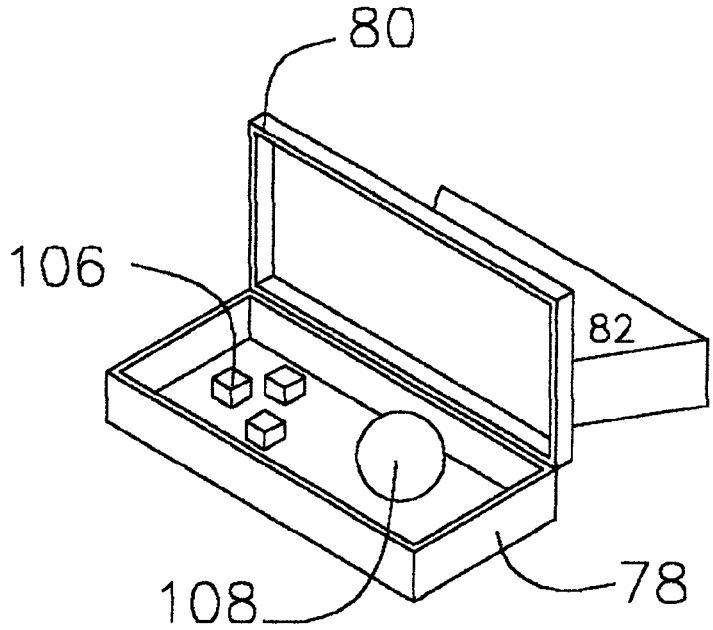
FIG. 13A is a perspective view of portions of the present invention.

Turning to FIGS. 13A and 13B, shown therein is a chalk and cue ball container 78 with lid 80 open (FIG. 13A) with attached rack and ball container 82 having the flap 84 open (FIG. 13B) for receiving a rack 86 with the balls 88 therein. The purpose of this is to allow the rack 86 to have a pre-prepared set of billiard balls 88 for placement in the container 82 so they can be deployed quickly onto a leveled playing surface. The cue ball 108 may be quickly retrieved from the cue ball container 78 with accompanying chalk 106 readily available for the tips of the cues. FIG. 13A shows the lid 80 open along with chalk 106 and cue ball 108, and FIG. 13B shows the lid closed. Container 82 is sized and shaped as rack 86 and containers 78 and 82 are attached.

Figure 14A:
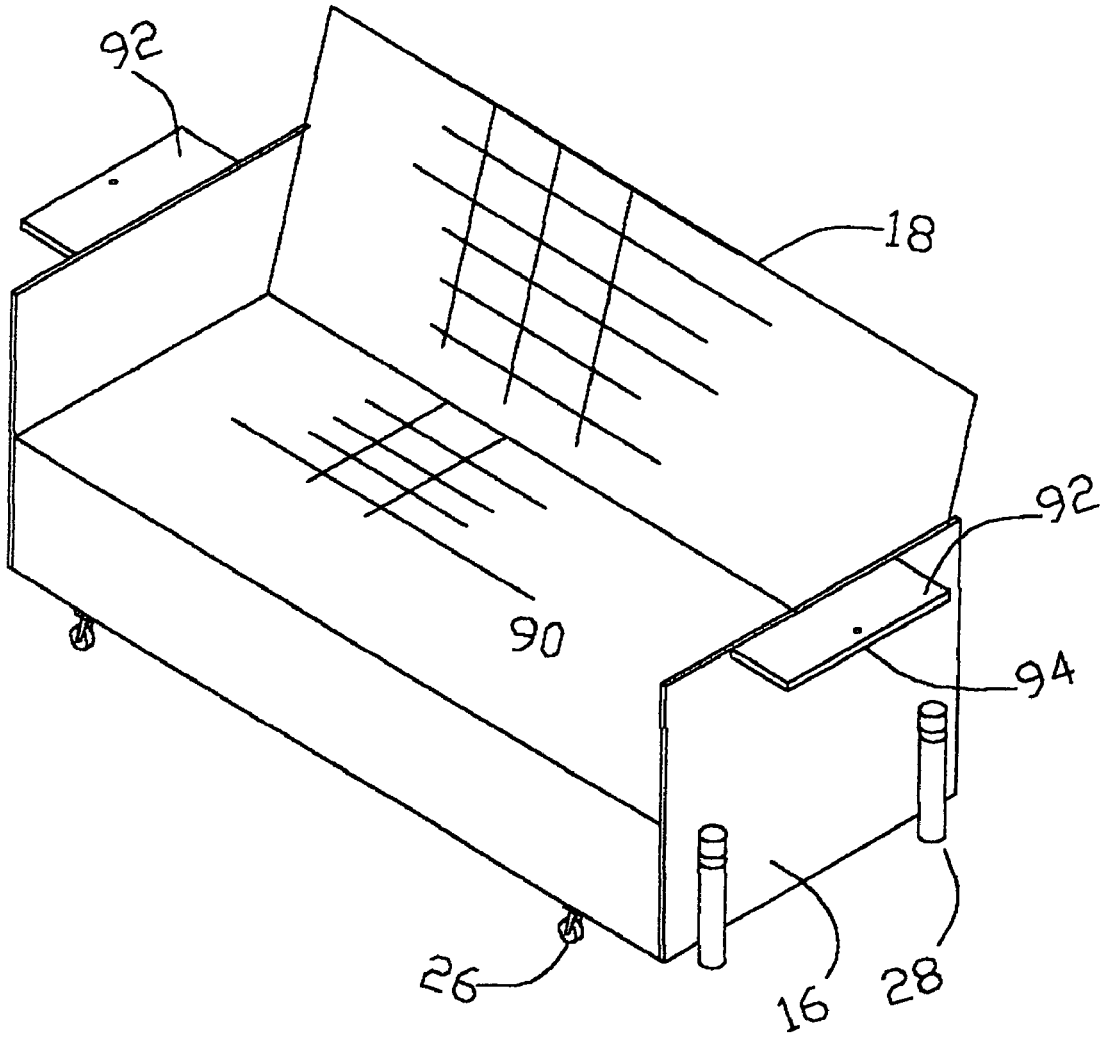
FIG. 14A is a perspective view of portions of the present invention.
Figure 14B:
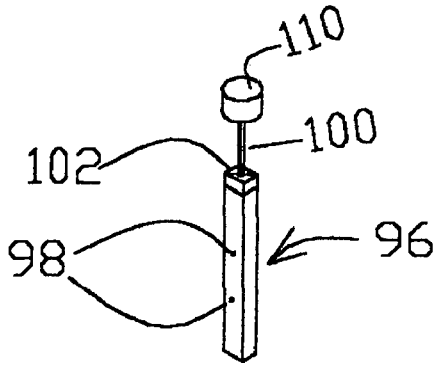
FIG. 14B is a perspective view of portions of the present invention.
Figure 15:
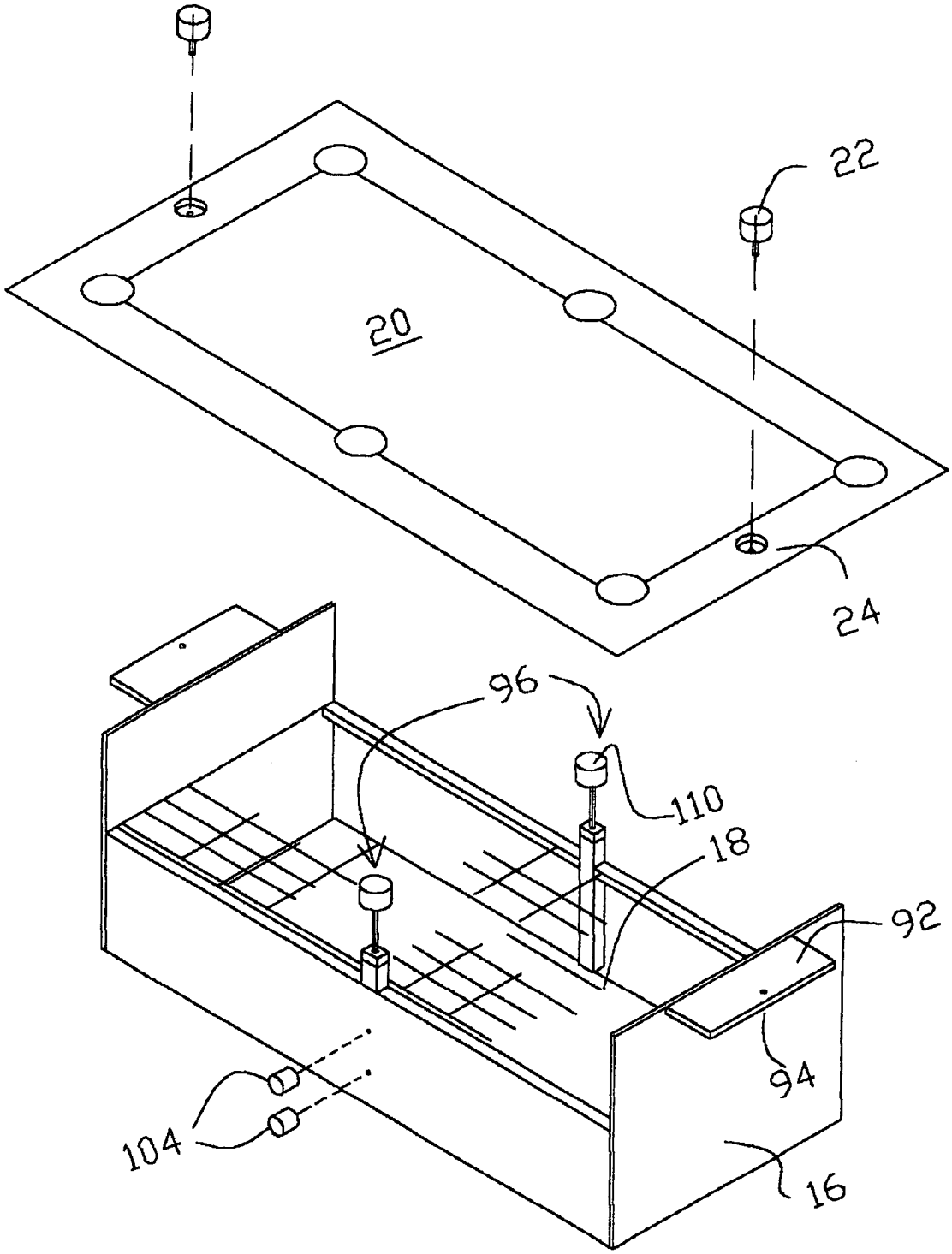
FIG. 15 is an exploded perspective view of portions of the present invention.
Figure 16:
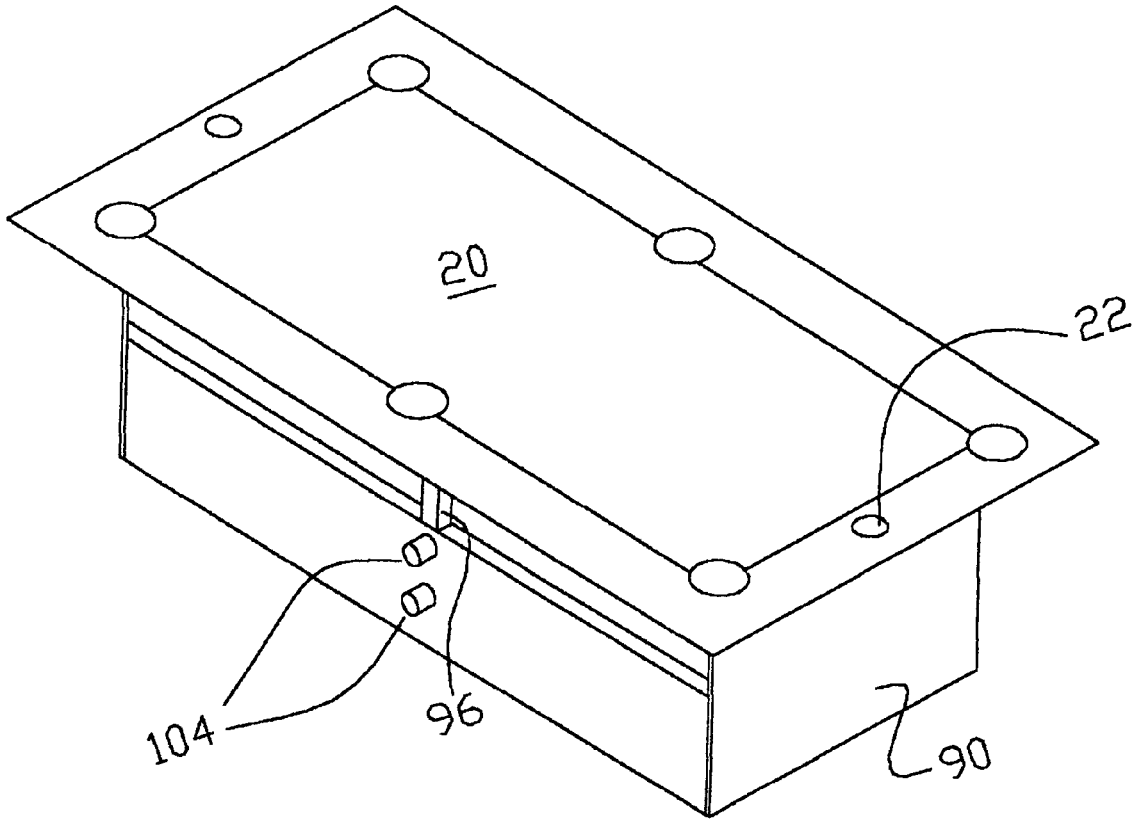
FIG. 16 is a perspective view of portions of the present invention.

Turning to FIGS. 14-16, shown therein is 14A showing the front of couch 16, back 18 (this may be a foldable hinged back support), and having a futon or mattress 90 thereon, i.e., a futon as used herein generally refers to a mattress-like member for providing a substantially flat surface for sleeping thereon, wherein the couch has an end member 92 on each end for receiving a hand bolt at aperture 94. FIG. 14B shows a center support member 96 having threaded holes 98 spaced apart therein along with a rotatable threaded rod 100, threaded nut 102, and vertically adjustable end cap 110 which member 96 is attached to the couch 16 when the couch is used to support the playing surface. The playing surface 20 is attached using the connecting hand bolts 22 with threaded portion 23 passing through aperture 24 into receiving member 92 on the couch 16 wherein the aperture 94 receives the threaded portion of the connecting hand bolt 22. The center supports 96 are shown attached to opposing sides, i.e., front and rear sides, of the couch 16 using hand bolts 104 for being connected to the front and rear sides of couch 16 about midway between the ends of the couch. The playing surface 20 with connecting hand bolts 22 is attached to the upper portion of couch 16 using the hand bolts 22 which pass through apertures 24 into the couch for attachment to the member 92 on the couch 16. Center supports 96 having vertically adjustable end caps 110 thereon are then used to steady playing surface 20 on couch 16 by having the end caps contact the bottom surface of the playing surface 20. FIG. 15 shows the hinged back support 18 folded down so as to lie flat on the futon when the couch 16 is being used to support the playing surface 20.

Figure 17:
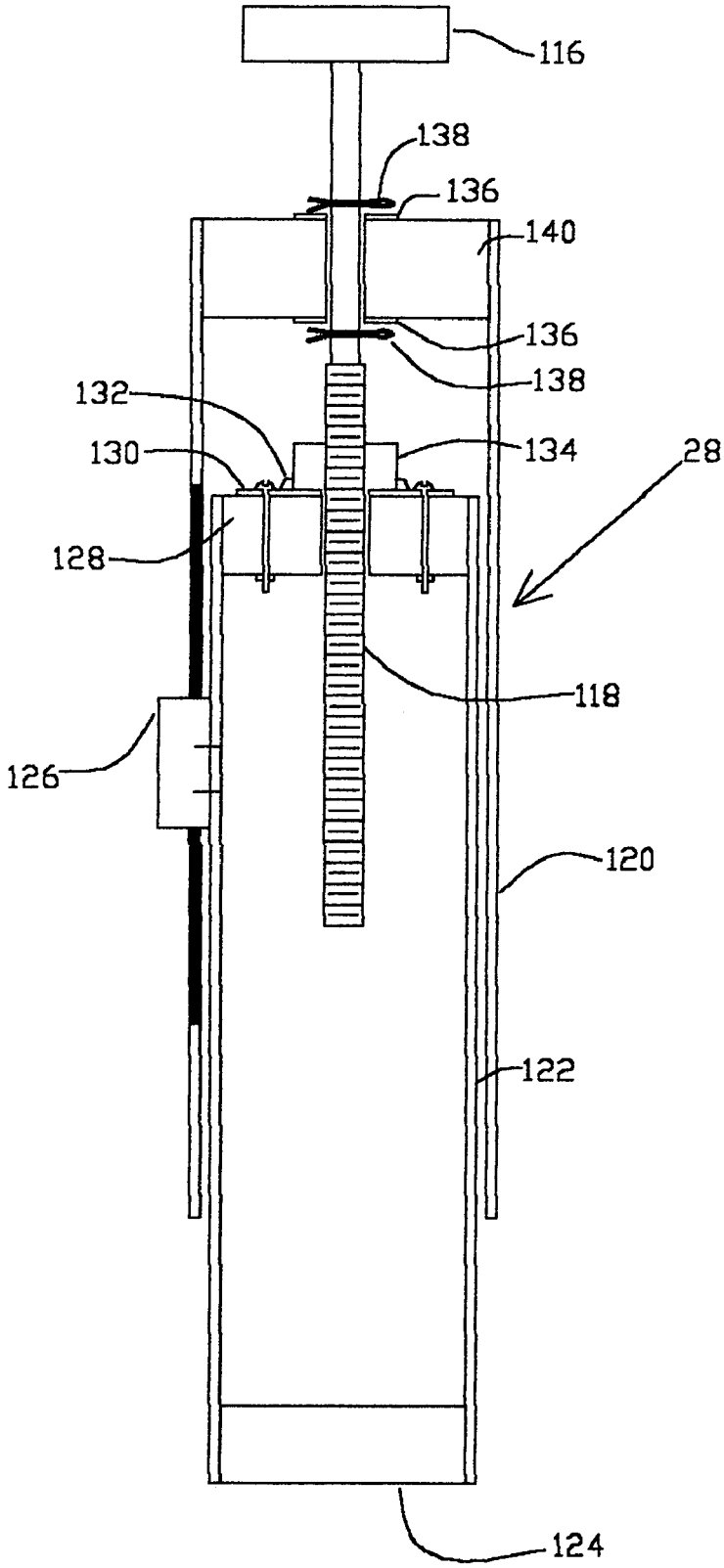
FIG. 17 is a cross-sectional elevation view of portions of the present invention.

Turning to FIG. 17, therein is shown the cross-sectional view of leveler 28 showing knob 116, which is rotated by hand being connected to one end of threaded rod 118, which is mounted and installed in steel tube 120. Shown is schedule 40 pvc pipe 122, or like, machined to fit inside steel tube 120, along with a plastic or wood end plug 124, which fits inside the pvc pipe. Also shown is a guide 126 which prevents the pvc pipe 122 from rotating, which guide runs in a slot in the steel tube 120. Also shown is a plastic or wood plug 128 inside pipe 122 having a washer 130 thereon welded at 132 to a threaded nut 134. Also shown are mating washers 136 and cotter pins 138 which hold rod 118 inside the upper end plug/seal 140, which seal has an aperture 142 therein through which rod 118 extends. It should be understood that when a user rotates knob 116, which turns rod 118, that the inner pvc pipe 122 is moved vertically inside steel tube 120 which is attached to the end or corner of the couch 16. This thereby levels the playing surface 20 mounted on couch 16 to which leveler 28 is attached.

Figure 18:
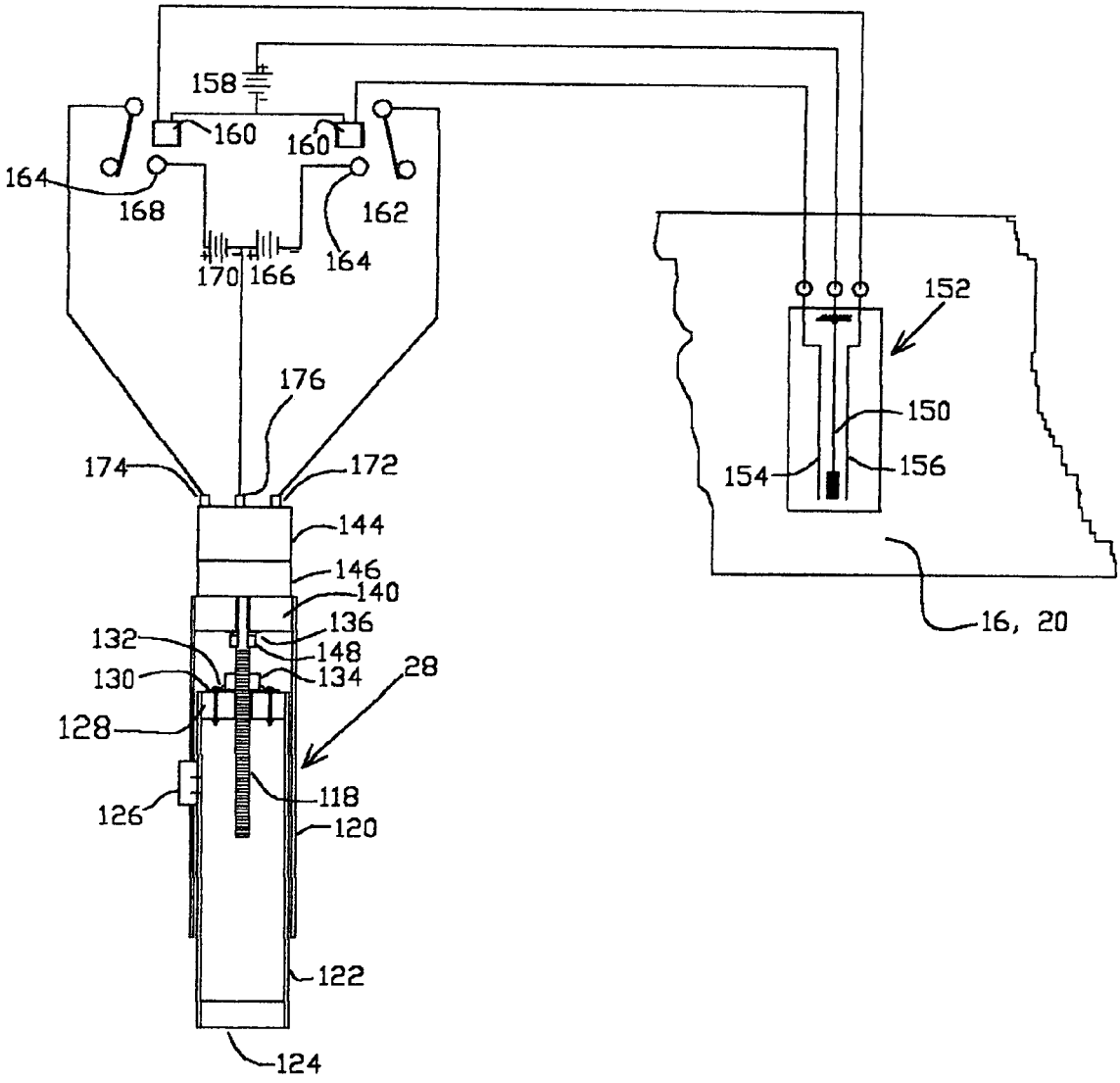
FIG. 18 is a cross-sectional view of a portion of the present invention along with a schematic diagram of a portion of the present invention.

Turning to FIG. 18, therein is shown the leveler 28 having a dc motor 144 attached to a gear box 146 on the upper end of leveler 28. The elements of the leveler 28 include washer 136, collar 148, steel tube 120, threaded rod 118, pvc pipe 122, plastic or wood plug 124, washer 130, weld 132, guide 126, and end plug 140, all of which are substantially similar to the corresponding elements of the leveler 28 as shown in FIG. 17. Essentially the leveler 28 of FIG. 17 is equipped with a gear box 146 and dc motor 144 rotatably connected to rod 118 as shown in FIG. 18. While a dc motor and circuit are disclosed an ac motor and circuit could also be used. Also shown is an exemplary schematic circuit for an automatic direct current motor-driven leveler 28 which includes dc motor 144 which motor-driven leveler is controlled with the exemplary circuit disclosed in FIG. 18. The motor 144 is activated when the pendulum 150 (i.e., an electrical conductor), which is disposed in the level sensor 152 which is mounted on or operationally connected to playing surface 20 or couch 16, touches either plate electrode 154 or plate electrode 156. The pendulum is an electrical conductor. When the pendulum 150 touches 154 battery 158 provides a current through the coil 160 in electrical relay 162 which in turn closes contact 164 in the relay which causes battery 166 to send a current to the dc motor 144 terminal 172 which causes clockwise rotation. The dc motor 144 shaft rotation in the counter-clockwise direction is obtained when pendulum 150 contacts plate electrode 156 which causes a current to flow in the coil of relay 168 resulting in a current through battery 170 flowing to the terminal 174 of the dc motor 144. Neutral/ground terminal 176 is also shown. The dc motor 144 has no rotation when the pendulum 150 moves to an intermediate position (i.e. indicating a level condition) wherein the pendulum does not contact either electrode 154 or 156.

I claim:

1. An apparatus for assembly and leveling of a playing surface for playing billiards thereon, the playing surface having a plurality of pockets, comprising:

a) a playing surface suitable for playing billiards thereon, said playing surface being generally rectangular having top and bottom surfaces, first and second sides, and first and second ends, wherein said ends are shorter in length than said sides, wherein billiards is played on said top surface;

b) wherein each said end of said playing surface has an aperture therein, wherein each said aperture extends from said top surface to said bottom surface so as to pass entirely through said playing surface, wherein each said aperture is disposed intermediate said end;

c) a couch being generally rectangular and having four corners, said couch having upper and lower surfaces, front and back sides, and first and second ends, wherein said first and second sides and said first and second ends of said playing surface generally correspond to said front and back sides and said first and second ends of said couch, respectively, and, an end member disposed on each said first and second end thereof, wherein each said end member has a threaded aperture therein;

d) wherein said playing surface is removably attached to said upper surface of said couch so that billiards can be played on said top surface of said playing surface, wherein a connecting hand bolt passes through each said aperture of said playing surface into said threaded aperture of said end member so as to removably attach said playing surface to said couch;

e) a vertically adjustable center support being disposed intermediate each said front and back side of said couch, each said center support having a vertically adjustable end cap thereon, wherein said end cap contacts said bottom surface of said playing surface so as to support said playing surface on said couch; and, f) a leveler being disposed on each said corner of said couch so that said playing surface can be leveled so that billiards can be played thereon.

2. The apparatus of claim 1, wherein said back side of said couch has a plurality of slots therein, and a storage area therein, and a hand hole therein, wherein a cue stick can be stored in each of said slots, wherein articles can be stored in said storage area, wherein a portion of said center support passes through said hand hole, wherein said center support can be adjusted by having a hand of a user pass through said hand hole so as to adjust said center support.

3. The apparatus of claim 2, further comprising first and second wall mounting fixtures, wherein said fixtures are adapted to be attached to a wall, wherein said fixtures are adapted to receive said playing surface thereon.

4. The apparatus of claim 3, further comprising a rack and ball container being generally shaped to receive a rack containing pool balls therein, a chalk and cue ball container, wherein said rack and ball container is attached to said chalk and cue ball container, wherein said rack and ball container and said chalk and cue ball container can be stored in said storage area on said back side of said couch.

5. A method for assembly and leveling of a playing surface for playing billiards thereon, the playing surface having a plurality of pockets, comprising the steps of:

a) providing a playing surface suitable for playing billiards thereon, the playing surface being generally rectangular having top and bottom surfaces, first and second sides, and first and second ends, wherein the ends are shorter in length than the sides, wherein billiards is played on the top surface;

b) wherein each end of the playing surface has an aperture therein, wherein each aperture extends from the top surface to the bottom surface so as to pass entirely through the playing surface, wherein each aperture is disposed intermediate the end;

c) providing a couch being generally rectangular and having four corners, the couch having upper and lower surfaces, front and back sides, and first and second ends, wherein the first and second sides and the first and second ends of the playing surface generally correspond to the front and back sides and the first and second ends of the couch, respectively, and, an end member disposed on the first and second end thereof, wherein each end member has a threaded aperture therein;

d) wherein the playing surface is removably attached to the upper surface of the couch so that billiards can be played on the top surface of the playing surface, wherein a connecting hand bolt passes through each aperture of the playing surface into the threaded aperture of the end member so as to removably attach the playing surface to the couch;

e) providing a vertically adjustable center support intermediate each front and back side of the couch, each center support having a vertically adjustable end cap thereon, wherein the end cap contacts the bottom surface of the playing surface so as to support the playing surface on the couch; and, f) providing a leveler on each corner of the couch so that the playing surface can be leveled so that billiards can be played thereon.

6. The method of claim 5, wherein the back side of the couch has a plurality of slots therein, and a storage area therein, and a hand hole therein, wherein a cue stick can be stored in each slot, wherein articles can be stored in the storage area, wherein a portion of the center support passes through the hand hole, wherein the center support can be adjusted by having a hand of a user pass through the hand hole so as to adjust the center support.

7. The method of claim 6, further comprising the steps of providing first and second wall mounting fixtures, wherein the fixtures are adapted to be attached to a wall, wherein the fixtures are adapted to receive the playing surface thereon.

8. The method of claim 7, further comprising the steps of providing a rack and ball container being generally shaped to receive a rack containing pool balls therein, and a chalk and cue ball container, wherein the rack and ball container is attached to the chalk and cue ball container, wherein the rack and ball container and the chalk and cue ball container can be stored in the storage area on said back side of the couch.

9. The apparatus of claim 1, further comprising means for electrically operating said leveler whereby said playing surface can be substantially leveled.

* * * * *